United States Patent [19]

Dunlap et al.

[11] 4,282,727

[45] Aug. 11, 1981

[54] DECORATIVE FOOTLET-TYPE SOCK

[75] Inventors: Albert R. Dunlap, Mt. Airy; Dallas G. Nester, Burlington, both of N.C.

[73] Assignee: Brown Wooten Mills, Inc., Burlington, N.C.

[21] Appl. No.: 97,134

[22] Filed: Nov. 26, 1979

[51] Int. Cl.[3] ..... D04B 9/46

[52] U.S. Cl. ..... 66/172 E

[58] Field of Search ..... 66/178 R, 178 A, 172, 66/173, 172 E, 169–171; 2/239

[56] References Cited

U.S. PATENT DOCUMENTS

| | | | |
|---|---|---|---|
| 3,274,804 | 9/1966 | Thorneburg et al. | 66/172 E |
| 3,990,115 | 11/1976 | Nester | 66/172 E |
| 4,034,580 | 7/1977 | Holder | 66/172 E |
| 4,047,400 | 9/1977 | Thorneburg | 66/173 X |
| 4,194,249 | 3/1980 | Thorneburg | 2/239 |

*Primary Examiner*—Ronald Feldbaum

*Attorney, Agent, or Firm*—Charles R. Rhodes; Judith G. Smith

[57] ABSTRACT

The exposed welt of a footlet-type sock is divided by knit construction into a rear portion and a front portion. The rear portion, which is substantially the rear half, is of a substantially freely and outwardly rolled construction. The rolled rear portion is not tacked down and encircles the lower ankle area when emplaced on the foot. The remainder or front portion includes an upper edge which is tacked down in a controlled folded construction. The rear portion is thus left free to roll upon itself into a relatively heavy, thick mass of material. The front portion, on the other hand is folded across the instep of the wearer minimizing the thickness of material beneath the shoe tongue. The rear half is a knitted fabric formed with a combination of body yarn and elastic yarn. The elastic yarn forms the backing fabric for the body yarn, which itself is formed into terry loops. The front portion of the decorative welt may be made with any type of construction as long as it is tacked down and not allowed to freely roll. In a preferred form of the present invention of the front portion of the welt is as a ribbed construction. In this front portion selected wales include stitches which are formed and cast off separated by at least two successive wales of float stitches. In the resulting fabric relatively wide bands of raised fabric are separated by relatively narrow bands of base fabric which exhibit a low relief area.

4 Claims, 3 Drawing Figures

Fig. 1
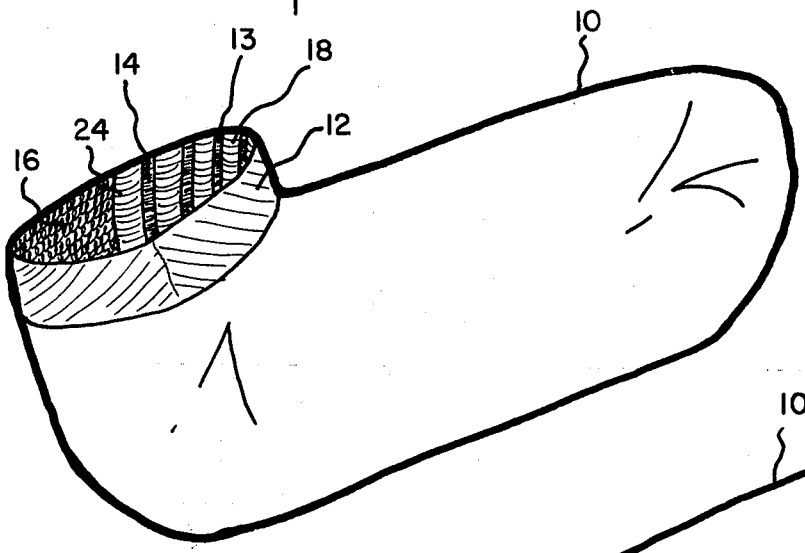
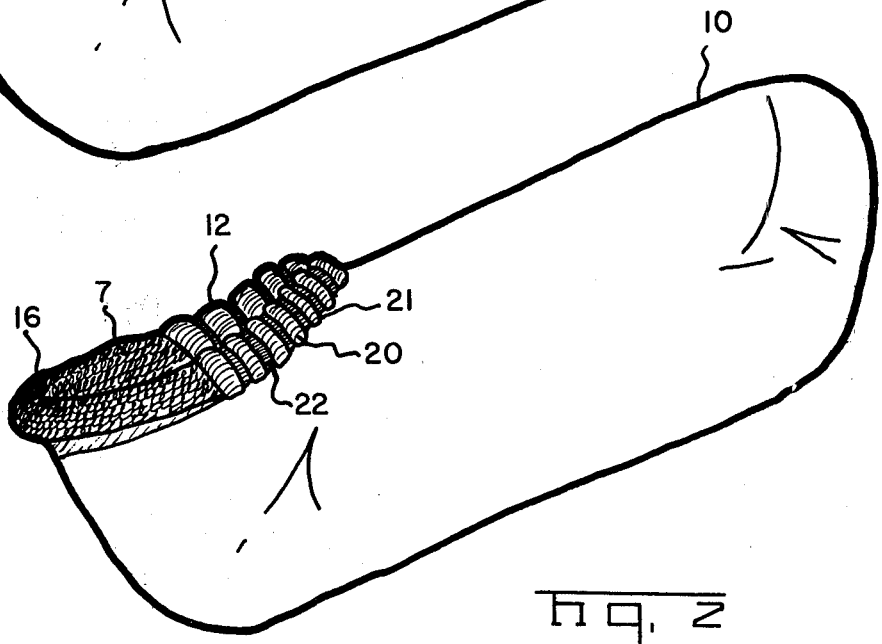
Fig. 2

DECORATIVE FOOTLET-TYPE SOCK

BACKGROUND OF THE INVENTION

During the last several years low-cut or footlet-type athletic socks have become quite popular, especially amongst lady golfers and tennis players. While male athletes also wear the footlet-type sock the demand for decorative type footlets is not as great with males as with females. The footlets for female athletes have included several types of unique decorations around the top. Some have included ribbons around the upper edge or welt, pom-poms around the rear thereof, and some have included a combination of both.

U.S. Pat. No. 3,274,804 to Thornburg et al describes and illustrates such a sock that has a roll top construction with terry loops on the inside. A rear and forward tab are knit and caused to roll down upon themselves when emplaced on the foot of the wearer. Such products have been generally acceptable; however, are open to some comfort objections. The front rolled down portion tends to work beneath the tongue of the shoe where its thickness causes discomfort to the wearer. U.S. Pat. No. 3,990,115 to Nester is illustrative of an alternate approach of the earlier mentioned Thornburg et al patent. In this sock the sides are tacked down to better cause the front and rear portions to conform to the configuration of the shoe.

SUMMARY OF THE PRESENT INVENTION

The present invention, on the other hand, is directed to a footlet-type sock having an improved decorative welt which is divided into a front and rear portion. The rear portion is of a substantially freely and outwardly rolled construction which is adopted to better encircle the lower ankle area. The front portion, on the other hand, is tacked down in a controlled, folded construction. Such construction better fits across the instep of the foot without causing an uncomfortable mass of material beneath the shoe tongue.

The rear, rolled construction is formed by a plurality of courses knit with a combination body yarn and elastic yarn. The body yarn is formed into terry loops on the inside of the welt area and the elastic yarn forms the backing therefor. The elastic yarn in the backing causes a better and bulkier appearing roll than heretofore known.

In the front portion, in a preferred embodiment, the welt is so formed as to give a ribbed appearance. A plurality of raised, bulky wale-wise ribs or high relief bands are separated by a plurality of relatively narrow, low relief, wale-wise bands. Such construction is described more in detail in my co-pending U.S. patent application No. 083,255, filed 10-10-79. The front portion is also formed by a plurality of courses combining an elastic yarn and a second or body yarn knitted in plated relationship. Each of the courses includes wales of knit stitches separated by at least two adjacent wales of float stitches. The use of the elastic yarn combined with the body yarn in the floats form the desired bulky, high relief bands.

The improved rear portion tends to continuously roll down upon itself from top to bottom stopped only by the upper edge of the shoe. The folded front portion of the welt area is, however, prevented from amassing beneath the tongue of the shoe as would be the case if it were rolled. Further, the controlled, folded and tacked down front portion provides a more uniform front area than with a rolled construction. The overall visual effect of the sock with the rolled back and folded down front shows that there is a distinct difference between the front and rear construction. The purchaser is thereby made aware that the sock will not be subject to the disadvantages suffered by those roll-top socks known heretofore.

It is therefore an object of the present invention to provide a footlet-type sock with a unique decorative exposed welt.

It is another object of the present invention to provide distinct types of construction in the front and rear portions of a footlet sock.

It is still a further object of the present invention to provide a footlet-type sock with a freely and outwardly rolled, rear portion and tacked down in a controlled, folded front portion.

It is yet a further object of the present invention to provide a footlet-type sock of the type described in which the front portion of the welt is so constructed as to give the appearance of a plurality of wide, high relief vertical ribs, separated by relatively narrow, low relief grooves.

Other objects and a fuller understanding of the invention will become apparent upon reading the following detailed description of a preferred embodiment along with the accompanying drawings in which:

FIG. 1 is a perspective view of a footlet-type sock formed according to the present invention with the welt area upstanding from the sock;

FIG. 2 is a perspective view similar to FIG. 1, except showing the sock in its final form; and FIG. 3 is a stitch diagram of a portion of the welt area of the sock, illustrating a section of the roll down area adjacent to a section of the tacked down, controlled folded knit construction, and showing the technique by which the welt area is formed.

DETAILED DESCRIPTION OF A PREFERRED EMBODIMENT

Figure 7:
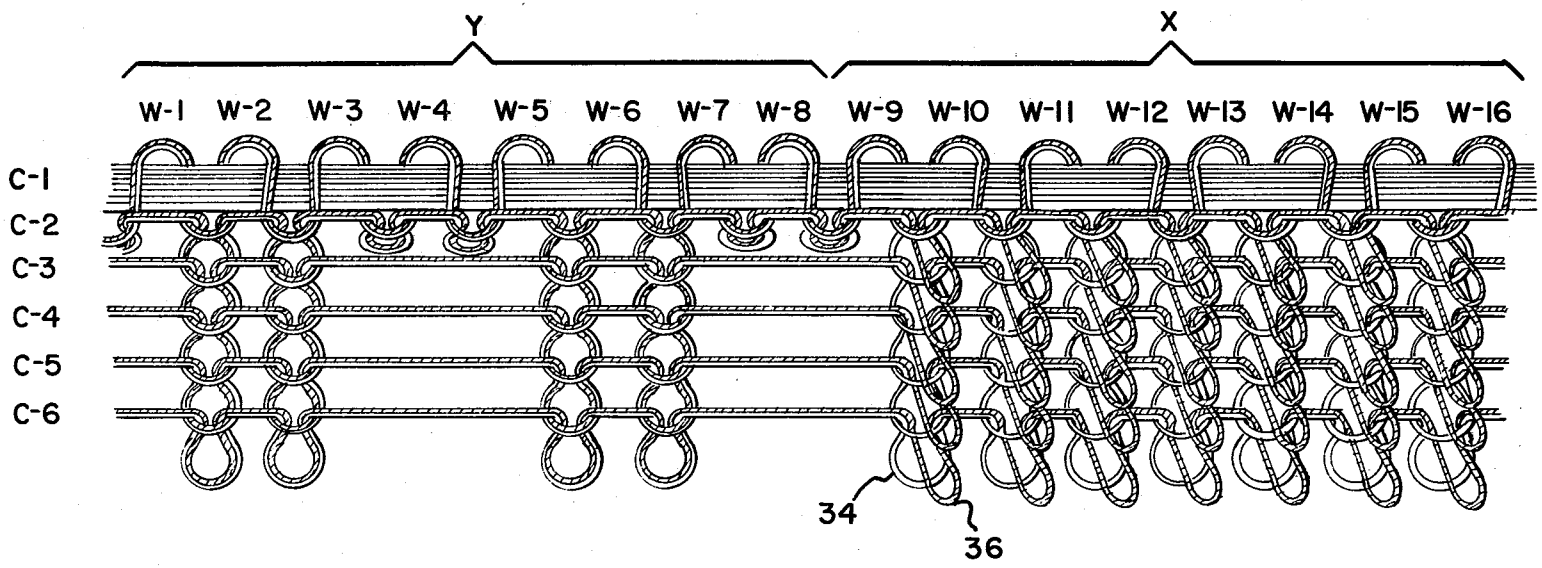

Turning now to the drawings, and particularly to FIGS. 1 and 2, there is illustrated a low cut footlet-type sock 10 of the type with which the present invention is concerned. Such socks include a welt portion 12 forming an opening 14 which surrounds the ankle of the wearer. FIG. 1 is illustrative of a sock having the transfer stitches, holding the upper edge 13 of the forward portion of the welt 14 down onto the sock, cut. In this regard, FIG. 1 is for the purpose only of showing that the high and low relief areas of the welt are formed on the inside surface thereof during knitting. Then when the welt is turned down and tacked or transferred there results a sock 10 with the appearance of FIG. 2.

In general, the welt area 12, as illustrated in FIG. 2 is formed of a rear half or portion 16 and a front half or portion 18. Rear portion 16 and front portion 18 are formed with two distinct types of constructions, giving unique characteristics to the final sock. As illustrated in FIG. 2 the rear portion 16, which includes a plurality of terry loops on the inside surface thereof, freely and outwardly rolls down when emplaced on the foot of the wearer. On the other hand, the front portion 18 in a preferred embodiment is formed of a plurality of ribs, flutes, scallops 20 which gives the appearance of alternating high and low relief bands. The high relief areas or flutes 20 are separated by low relief portions 22. In the preferred embodiment the high relief ribs 20 are relatively wide as compared to the separating or low relief ribs 22, even though in forming the stocking as will be described hereinbelow the number of wales in each portion may be the same.

The rear construction illustrated in FIG. 1 and 2 cause the sock, when emplaced on the wearer to roll down to the upper edge of the shoe in the heel area. The heel area of the shoe fits snugly against the surface of the sock below the rolled portion. So arranged as the rear portion rolls, it will not slip down in behind the heel of the shoe. The upper edge 13 of the front portion 18, on the other hand, is tacked down to form a controlled folded construction, less bulky than the rear portion. A rolled front portion is now realized to be undesirable because it tends to slip down under the tongue of the shoe which does not fit as snugly across the instep as the heel portion does. Either in the construction of the stocking 10 or subsequent thereto the upper 13 of the front portion 18 of the welt is turned down and tacked into the sock along lines 20. This may be accomplished by transfer knitting in a well-known technique, or by tacking separately on a sewing machine.

Turning now to FIG. 3, there is illustrated the method of construction of the welt 12 according to the present invention. It can be seen that construction is initially started by laying in a make-up course. In the make-up course elastic yarns E are fed to every other needle while being floated inside the remaining needles during several rotations of the needle cylinders. A body yarn 30 and an elastic yarn 32 in an initial course C-1 are then fed to and form stitch loops on every needle so that adjacent stitch loops are formed in course C-1 on opposite sides of the inlaid elastic yarns E. During the next rotation of the needle cylinder (course C-2) both the body yarn 30 and the elastic yarn 32 are fed to every needle to tie in the body yarn 30 and the elastic yarn 32 which surrounds the elastic strands E.

Moving now to course C-3, the normal knitting of the welt area begins in which, it must be first realized that two separate types of knitting occur in each course. FIG. 3 has been divided into two sections X and Y corresponding in construction to the rear welt area 16 and the front welt area 18 respectively. Section Y is schematically composed of wales W-1 through W-8 for purposes of illustration only. Section X on the other hand is schematically composed of wales W-9 through W-16. It should also be realized that the intersection of section Y and section X corresponds to the side portion of the welt 12 where rear portion 16 meets front portion 18 as represented at 24 in FIG. 1. Thus in a 108 needle machine, section x includes about 55 wales and likewise section y.

First of all it is noted that all courses are constructed with a combination of an elastic yarn 32 and a body yarn 30 which may be a textured synthetic yarn such as nylon or polyester, a synthetic yarn such as acrylic, or a naturally occurring yarn such as cotton. In courses C-3 through the remainder of the welt area 12 area x (which forms the rear portion of the sock welt and is represented by wales W-9 through W-16) includes stitch loops formed by conventional loops 34 of the elastic yarn 32 and terry loops 36 of the body yarn 30. It is felt that the formation of terry loops is sufficiently well known that it is not necessary to describe how the elastic yarn would be formed into the backing fabric and the body yarn 30 would be caught on the nebs of the sinkers and pulled to form the terry loops 36. Although terry loops are known, it is not known and believed to be unique to use elastic knit loops in the backing for the terry loops.

Turning now to area Y which is illustrative of the front portion 18 of the welt area 12, in a preferred embodiment, both the body yarn 30 and the elastic yarn 32 are formed into knit stitches in wales W-1, W-2, then floated for the next two successive wales W-3, W-4, then knit again in wales W-5, W-6, then floated again in wales W-7, W-8. This construction continues around the front portion 18 of the welt 12. During formation of the welt area, the elastic or rubber yarn is kept under a slightly greater tension than normal to accentuate the bulk appearance of the high relief ribs 20. The tension is relaxed at the bottom end of the welt area for a few courses (preferably four) so that the rubber will not retract after it is cut. Course C-3 is duplicated for a prescribed number of courses as described hereinabove to form the welt 12. The first course, which has been held on the transfer needles is then transferred down and tacked into the stocking along line 21 in the front portion 18. The elastic yarns E help to keep the edge 13 folded down and the scallop surface properly formed. In the rear portion 16 of the sock, the elastic yarns E cause the fabric to freely roll outwardly and downwardly until stopped by the upper edge of the shoe. the remainder of the sock is then finished with the heel and toe portions being formed and the toes being closed in accordance with any known techniques.

While the footlet illustrated and described hereinabove has been disclosed as including a ribbed front portion 18, it is important to note that other types of construction could be utilized in the front portion of the sock, as long as it were tacked down in a folded welt construction, rather than allowed to freely roll which might then be caught under the tongue of the shoe. Also while the construction of the preferred embodiment illustrates the scalloped area being formed of courses in which two consecutive knit wales are alternated with two consecutive float wales, other combinations are possible. It is apparent that the same or a similar result would be reached even if one wale were knit followed by two or three wales of floats, or three wales were knit followed by two or three wales of floats, or any other combination of knits and floats.

While a preferred embodiment of the present invention has been described in detail hereinabove, it is apparent that various modifications and changes might be made without departing from the scope of the invention which is set forth in the accompanying claims.

What is claimed is:

1. A knit, low-cut, footlet-type sock adapted to be worn inside a low-cut shoe and substantially covered thereby with the exception of an exposed decorative welt, said welt comprising:

(a) a rear portion extending around substantially the rear half of said welt, said rear portion comprising a substantially freely and outwardly rolled construction which encircles the lower ankle area when emplaced on the wearer, said rolled construction including a plurality of courses knit with a combination body yarn and elastic yarn with the body yarn formed in terry loops and the elastic yarn forming the backing therefor; and (b) a front portion extending around substantially the front half of said welt, the upper edge of said front portion being tacked down to the lower edge of said welt portion in a controlled, folded construction;

(c) said front portion of said welt comprises: bands separated by at least one of relatively narrow, low relief wale-wise band;

(d) said high and low relief bands being formed the inside of said welt portion of said sock, the welt portion being turned down and attached to the bottom of said selt along the upper edge of the front portion of said sock.

2. A knit, low-cut, footlet-type sock adapted to be worn inside a low-cut show and substantially covered thereby with the exception of an exposed decorative welt, said welt comprising:

(a) a rear portion extending around substantially freely and outwardly rolled construction which encircles the lower ankle area when emplaced on the wearer, said rolled construction including a plurality of courses knit with a combination body yarn and elastic yarn forming the backing therefor; and a front portion extending around substantially the front half of said welt, the upper edge of said front portion being tacked down the the lower edge of said welt portion in a controlled, folded construction; said front portion of the exposed decorative welt comprises:

(b) a scalloped surface extending around at least a portion of said welt;

(c) said scalloped surface comprising (i) a plurality of courses wherein said elastic yarn and said body yarn are knitted in plated relationship;

(ii) each of said courses include knit stitches separated by a band of at least two adjacent float stitches;

(d) whereby the combination of said elastic yarn and said knitting construction case relatively bands or wale-wise ribs of raised fabric separated by a relatively narrow band of base fabric.

3. The sock according to claim 1 or 2 wherein said terry loops are formed on the inside of said rear portion whereby when said rear portion is rolled, the terry loops are exposed.

4. The sock according to claim 2 in which said scalloped surface is formed on the inside of said welt, and the welt is rolled over and tacked down exposing the scalloped surface on both the inside and outside of the exposed upper edge of the sock.

* * * * *